US008054086B2

(12) United States Patent
Rivenbark, Jr.

(10) Patent No.: US 8,054,086 B2
(45) Date of Patent: Nov. 8, 2011

(54) APPARATUS FOR DISPENSING AND DETECTING SOLID PHARMACEUTICAL ARTICLES AND RELATED METHODS OF OPERATION

(75) Inventor: James Robert Rivenbark, Jr., Raleigh, NC (US)

(73) Assignee: Parata Systems, LLC, Durham, NC (US)

( * ) Notice: Subject to any disclaimer, the term of this patent is extended or adjusted under 35 U.S.C. 154(b) by 120 days.

(21) Appl. No.: 12/491,691

(22) Filed: Jun. 25, 2009

(65) Prior Publication Data

US 2010/0332021 A1 Dec. 30, 2010

(51) Int. Cl.
*H01H 31/02* (2006.01)

(52) U.S. Cl. ..... 324/555; 324/556; 211/1; 211/7; 211/10; 700/231

(58) Field of Classification Search ..... None
See application file for complete search history.

(56) References Cited

U.S. PATENT DOCUMENTS

| | | | |
|---|---|---|---|
| 2,665,775 | A | 1/1954 | Smith |
| 2,708,996 | A | 5/1955 | Skillman |
| 2,865,532 | A | 12/1958 | Smith |
| 3,023,851 | A | 3/1962 | Stiller |
| 3,144,958 | A | 8/1964 | Gumpertz |
| 3,160,793 | A | 12/1964 | Colburn |
| 3,179,288 | A | 4/1965 | Davy |
| 3,185,851 | A | 5/1965 | D'Emilio |
| 3,196,276 | A | 7/1965 | Naab |
| 3,206,062 | A | 9/1965 | Rappaport |
| 3,310,199 | A | 3/1967 | Roberts |
| 3,312,372 | A | 4/1967 | Cooper, Jr. |
| 3,410,450 | A | 11/1968 | Fortenberry |
| 3,417,542 | A | 12/1968 | Merrill |
| 3,436,736 | A | 4/1969 | Platt |
| 3,556,342 | A | 1/1971 | Guarr |
| 3,599,152 | A | 8/1971 | Williams |

(Continued)

FOREIGN PATENT DOCUMENTS

CA 936 501 A1 11/1973

(Continued)

OTHER PUBLICATIONS

Examiner's Report dated Jul. 12, 2011 for counterpart application CA2,670,896.

*Primary Examiner* — Huy Q Phan
*Assistant Examiner* — Son Le
(74) *Attorney, Agent, or Firm* — Myers Bigel Sibley & Sajovec

(57) ABSTRACT

A method for dispensing and detecting solid pharmaceutical articles includes: forcing an article through a dispensing channel and past a sensor configured and positioned to detect the article passing through the dispensing channel, wherein the article includes one of the solid pharmaceutical articles; generating a detection signal using the sensor responsive to the article passing through the dispensing channel, wherein the detection signal indicates a time that the article takes to traverse the sensor; and determining whether the article is a complete article or an article fragment responsive to a comparison of the time indicated by the detection signal and an article fragment travel time representing an expected travel time for a complete article to traverse the sensor that is determined independent of physical attributes of the solid pharmaceutical articles.

18 Claims, 9 Drawing Sheets

U.S. PATENT DOCUMENTS

| | | | |
|---|---|---|---|
| 3,653,176 | A | 4/1972 | Gess |
| 3,730,388 | A | 5/1973 | Bender |
| 3,732,544 | A | 5/1973 | Obland |
| 3,780,907 | A | 12/1973 | Colburn |
| 3,815,780 | A | 6/1974 | Bauer |
| 3,837,139 | A | 9/1974 | Roseberg |
| 3,885,702 | A | 5/1975 | Joslin |
| 3,917,045 | A | 11/1975 | Williams |
| 4,066,173 | A | 1/1978 | Adams et al. |
| 4,223,751 | A | 9/1980 | Ayers et al. |
| 4,267,942 | A | 5/1981 | Wick |
| 4,434,602 | A | 3/1984 | Culpepper |
| 4,471,428 | A | 9/1984 | Dshkhunian et al. |
| 4,481,667 | A | 11/1984 | Price et al. |
| 4,546,901 | A | 10/1985 | Buttarazzi |
| 4,573,606 | A | 3/1986 | Lewis |
| 4,655,026 | A | 4/1987 | Wigoda |
| 4,664,289 | A | 5/1987 | Shimizu |
| 4,674,259 | A | 6/1987 | Hills |
| 4,674,651 | A | 6/1987 | Scidmore |
| 4,693,057 | A | 9/1987 | Rittinger |
| 4,695,954 | A | 9/1987 | Rose |
| 4,766,542 | A | 8/1988 | Pilarczyk |
| 4,767,023 | A | 8/1988 | Hackmann |
| 4,801,044 | A | 1/1989 | Kubota et al. |
| 4,805,377 | A | 2/1989 | Carter |
| 4,836,682 | A | 6/1989 | Keenan, III |
| 4,869,392 | A | 9/1989 | Moulding, Jr. |
| 4,918,604 | A | 4/1990 | Baum |
| 4,971,513 | A | 11/1990 | Bergerioux |
| 4,980,292 | A | 12/1990 | Elbert |
| 4,984,709 | A | 1/1991 | Weinstein |
| 5,018,644 | A | 5/1991 | Hackmann |
| 5,047,948 | A | 9/1991 | Turner |
| 5,317,645 | A | 5/1994 | Perozek et al. |
| 5,337,919 | A | 8/1994 | Spaulding et al. |
| 5,424,842 | A | 6/1995 | Poorman |
| 5,502,312 | A | 3/1996 | Lorenzo |
| 5,668,300 | A | 9/1997 | Krokel et al. |
| 5,768,327 | A | 6/1998 | Pinto et al. |
| 5,777,557 | A | 7/1998 | Fayfield |
| 5,808,296 | A | 9/1998 | McMonagle et al. |
| 5,884,806 | A | 3/1999 | Boyer et al. |
| 5,907,493 | A | 5/1999 | Boyer et al. |
| 5,923,427 | A | 7/1999 | Dong |
| 6,006,946 | A | 12/1999 | Williams et al. |
| 6,036,812 | A | 3/2000 | Williams et al. |
| 6,176,392 | B1 | 1/2001 | William et al. |
| 6,211,784 | B1 | 4/2001 | Nishide |
| RE37,829 | E | 9/2002 | Charhut |
| 6,492,821 | B1 | 12/2002 | Marko et al. |
| 6,561,377 | B1 | 5/2003 | Pearson et al. |
| 6,592,005 | B1 | 7/2003 | Coughlin et al. |
| 6,631,826 | B2 | 10/2003 | Pollard et al. |
| 6,736,286 | B2 | 5/2004 | Hashimoto et al. |
| 6,971,541 | B2 | 12/2005 | Williams et al. |
| 7,139,639 | B2 | 11/2006 | Broussard et al. |
| 7,168,480 | B2 | 1/2007 | Daniels et al. |
| 7,191,915 | B2 | 3/2007 | Hair, III et al. |
| 7,269,476 | B2 | 9/2007 | Ratnakar |
| 7,319,524 | B2 | 1/2008 | Friedrichs |
| 7,344,049 | B2 | 3/2008 | Daniels et al. |
| 7,832,591 | B2 | 11/2010 | Karwacki, Jr. et al. |
| 2004/0004085 | A1 | 1/2004 | Williams et al. |
| 2006/0088196 | A1 | 4/2006 | Popovich, Jr. et al. |
| 2006/0124656 | A1 | 6/2006 | Popovich, Jr. et al. |
| 2006/0241807 | A1 | 10/2006 | Daniels et al. |
| 2008/0283543 | A1* | 11/2008 | Karwacki et al. ..... 221/7 |
| 2008/0283734 | A1 | 11/2008 | Michelli |

FOREIGN PATENT DOCUMENTS

| | | | |
|---|---|---|---|
| CA | 2681274 | | 11/2008 |
| DE | 10309604 | A1 | 9/2004 |
| GB | 1168758 | A | 10/1969 |
| GB | 1411951 | A | 10/1975 |
| JP | 51-000792 | B | 1/1976 |
| JP | 52-047400 | A | 4/1977 |
| JP | 61-104904 | A | 5/1986 |
| JP | 63-208410 | A | 8/1988 |
| JP | 64-028102 | U | 2/1989 |
| JP | 1-288265 | A | 11/1989 |
| JP | 2-028417 | A | 1/1990 |
| WO | WO 2004/031742 | A1 | 4/2004 |

* cited by examiner

APPARATUS FOR DISPENSING AND DETECTING SOLID PHARMACEUTICAL ARTICLES AND RELATED METHODS OF OPERATION

FIELD OF THE INVENTION

The present invention is directed generally to the dispensing of solid pharmaceutical articles and, more specifically, is directed to the automated dispensing of solid pharmaceutical articles.

BACKGROUND

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. For example, U.S. Pat. No. 6,971,541 to Williams et al. describes an automated system for dispensing pharmaceuticals using dispensing bins. Each dispensing bin includes a hopper in which tablets are stored and a dispensing channel fluidly connecting the hopper to a dispensing outlet. Forward and reverse air flows are used to selectively convey the tablets through the dispensing channel in each of a dispensing direction (toward the outlet) and a reverse direction (toward the hopper). A counting sensor is positioned proximate the outlet of the dispensing channel and used to detect tablets passing the sensor in order to maintain a count of the tablets dispensed.

Although this particular system can provide automated pharmaceutical dispensing, certain of the operations may be improved. For example, the system may detect tablet fragments and classify them as complete tablets, resulting in an incorrect count of the complete tablets dispensed. Therefore, it may be desirable to provide a system in which tablet fragments are detected and classified as tablet fragments as they are dispensed.

SUMMARY

According to some embodiments of the present invention, a method for dispensing and detecting solid pharmaceutical articles includes: forcing an article through a dispensing channel and past a sensor configured and positioned to detect the article passing through the dispensing channel, wherein the article includes one of the solid pharmaceutical articles; generating a detection signal using the sensor responsive to the article passing through the dispensing channel, wherein the detection signal indicates a time that the article takes to traverse the sensor; and determining whether the article is a complete article or an article fragment responsive to a comparison of the time indicated by the detection signal and an article fragment travel time representing an expected travel time for a complete article to traverse the sensor that is determined independent of physical attributes of the solid pharmaceutical articles.

In some embodiments, the article fragment travel time includes a complete article travel time, representing an expected travel time that is determined independent of physical attributes of the solid pharmaceutical articles, multiplied by a fragment percentage value, wherein the fragment percentage value is configurable and represents a percentage of the article under which the article is considered as an article fragment.

In some embodiments, the step of determining whether the article is a complete article or an article fragment further includes: detecting a complete article where the time indicated by the detection signal is greater than or equal to the article fragment travel time; and detecting an article fragment where the time indicated by the detection signal is less than the article fragment travel time.

In some embodiments, the method includes: comparing the time indicated by the detection signal and the complete article travel time; and altering the complete article travel time responsive to the comparison. In some embodiments, the method further includes dynamically updating the article fragment travel time after altering the complete article travel time.

According to other embodiments of the present invention, an apparatus for dispensing and detecting solid pharmaceutical articles includes: a dispensing channel; a drive mechanism to force an article through the dispensing channel, wherein the article includes one of the solid pharmaceutical articles; a sensor configured and positioned to detect the article passing through the dispensing channel and generate a detection signal responsive thereto; and a controller. The controller is configured to: receive the detection signal from the sensor responsive to the article passing through the dispensing channel, wherein the detection signal indicates a time that the article takes to traverse the sensor; and determine whether the article is a complete article or an article fragment responsive to a comparison of the time indicated by the detection signal and an article fragment travel time representing an expected travel time for a complete article to traverse the sensor that is determined independent of physical attributes of the solid pharmaceutical articles.

In some embodiments, the article fragment travel time comprises a complete article travel time, representing an expected travel time that is determined independent of physical attributes of the solid pharmaceutical articles, multiplied by a fragment percentage value, wherein the fragment percentage value is configurable and represents a percentage of the article under which the article is considered as an article fragment.

In some embodiments, the controller is configured to: identify a complete article where the time indicated by the detection signal is greater than or equal to the article fragment travel time; and identify an article fragment where the time indicated by the detection signal is less than the article fragment travel time.

In some embodiments, the controller is configured to: compare the time indicated by the detection signal and the complete article travel time; and alter the complete article travel time responsive to the comparison. In some embodiments, the controller is further configured to dynamically update the article fragment travel time after altering the complete article travel time.

Although described above primarily with respect to apparatus and method aspects of the present invention, it will be understood that the present invention may also be embodied as computer program products.

DETAILED DESCRIPTION

Figure 1:
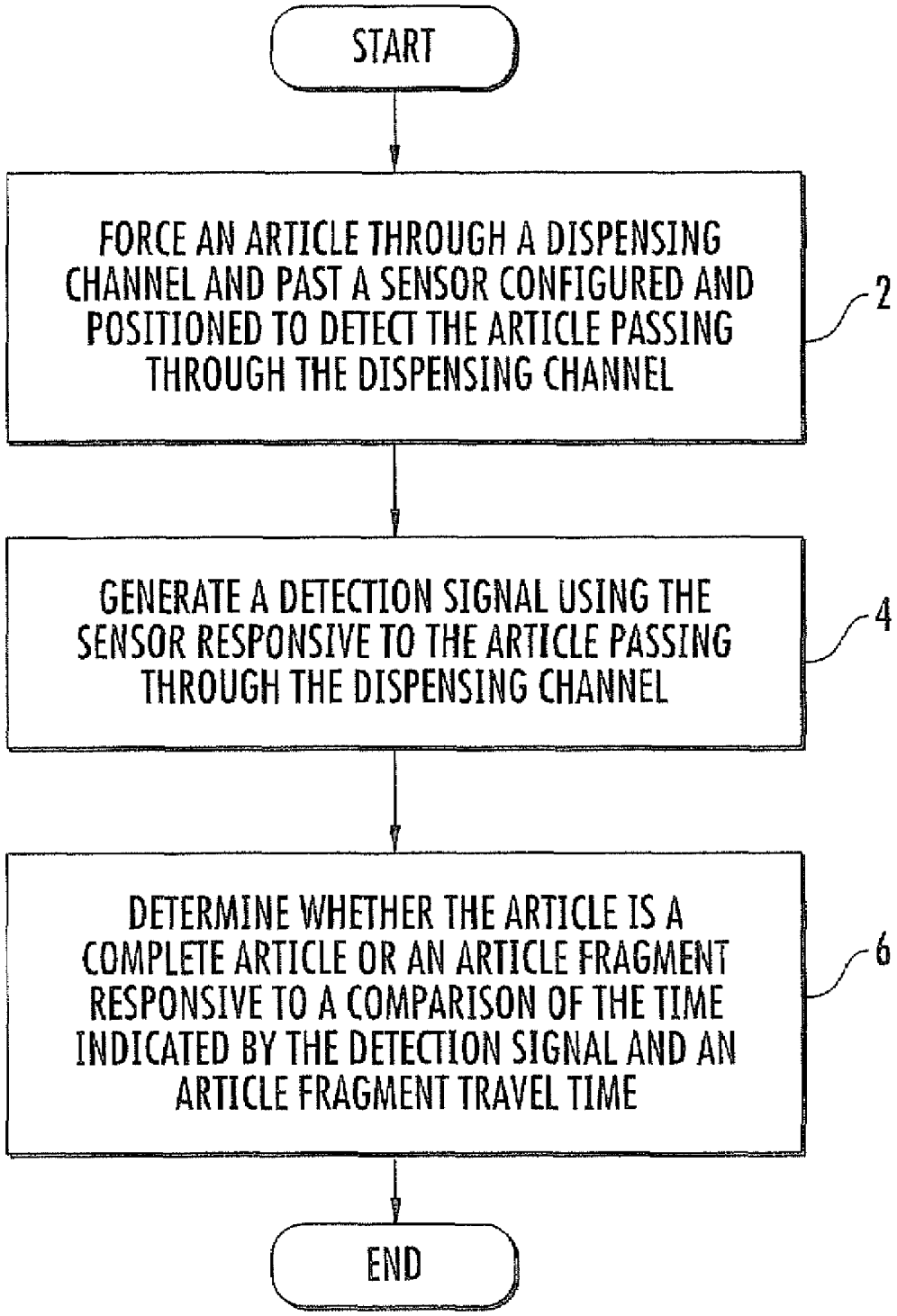
FIG. 1 is a flowchart illustrating operations according to some embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Some embodiments may be embodied in hardware (including analog circuitry and/or digital circuitry) and/or in software (including firmware, resident software, micro-code, etc.). Consequently, as used herein, the term "signal" may take the form of a continuous waveform and/or discrete value (s), such as digital value(s) in a memory or register. Furthermore, various embodiments may take the form of a computer program product on a computer-usable or computer-readable storage medium having computer-usable or computer-readable program code embodied in the medium for use by or in connection with an instruction execution system. Accordingly, as used herein, the terms "circuit" and "controller" may take the form of digital circuitry, such as a logic gate array and/or computer-readable program code executed by an instruction processing device(s) (e.g., general purpose microprocessor and/or digital signal processor), and/or analog circuitry. Although some of the diagrams include arrows on communication paths to show a primary direction of communication, it is to be understood that communication may occur in the opposite direction to the depicted arrows.

Well-known functions or constructions may not be described in detail for brevity and/or clarity.

As used herein, a "complete article" is typically a solid article deemed to be of sufficient size to be included in a system count. An "article fragment" is typically a partial (e.g., broken or fractured) solid article deemed to be of insufficient size to be included in the system count. For example, in some embodiments, a complete article may refer to a partial solid article representing more than about 50% of the solid article, while an article fragment may refer to a partial solid article representing less than about 50% of the solid article. According to some embodiments, the solid articles are solid pharmaceutical articles. In particular, the solid articles may be pharmaceutical pills or tablets.

In accordance with some embodiments, apparatus and methods are provided for dispensing and detecting solid pharmaceutical articles. In particular, such methods and apparatus may be used to detect and/or classify article fragments. An exemplary process is described generally with reference to FIG. 1. The process begins by forcing an article (i.e., one of the solid pharmaceutical articles) through a dispensing channel and past a sensor configured and positioned to detect the article passing through the dispensing channel (Block 2). A detection signal is generated using the sensor responsive to the article passing through the dispensing channel (Block 4). The detection signal indicates a time that the article takes to traverse the sensor. It is then determined whether the article is a complete article or an article fragment responsive to a comparison of the time indicated by the detection signal and an article fragment travel time (Block 6). The article fragment travel time represents an expected travel time for a complete article to traverse the sensor, and is calculated and/or determined independent of physical attributes of the solid pharmaceutical articles. Consequently, the article fragment travel time may represent a minimum travel time for a complete article to traverse the sensor and/or an upper time limit for an article fragment to traverse the sensor, and is calculated and/or determined independent of physical attributes of the solid pharmaceutical articles.

Figure 2:
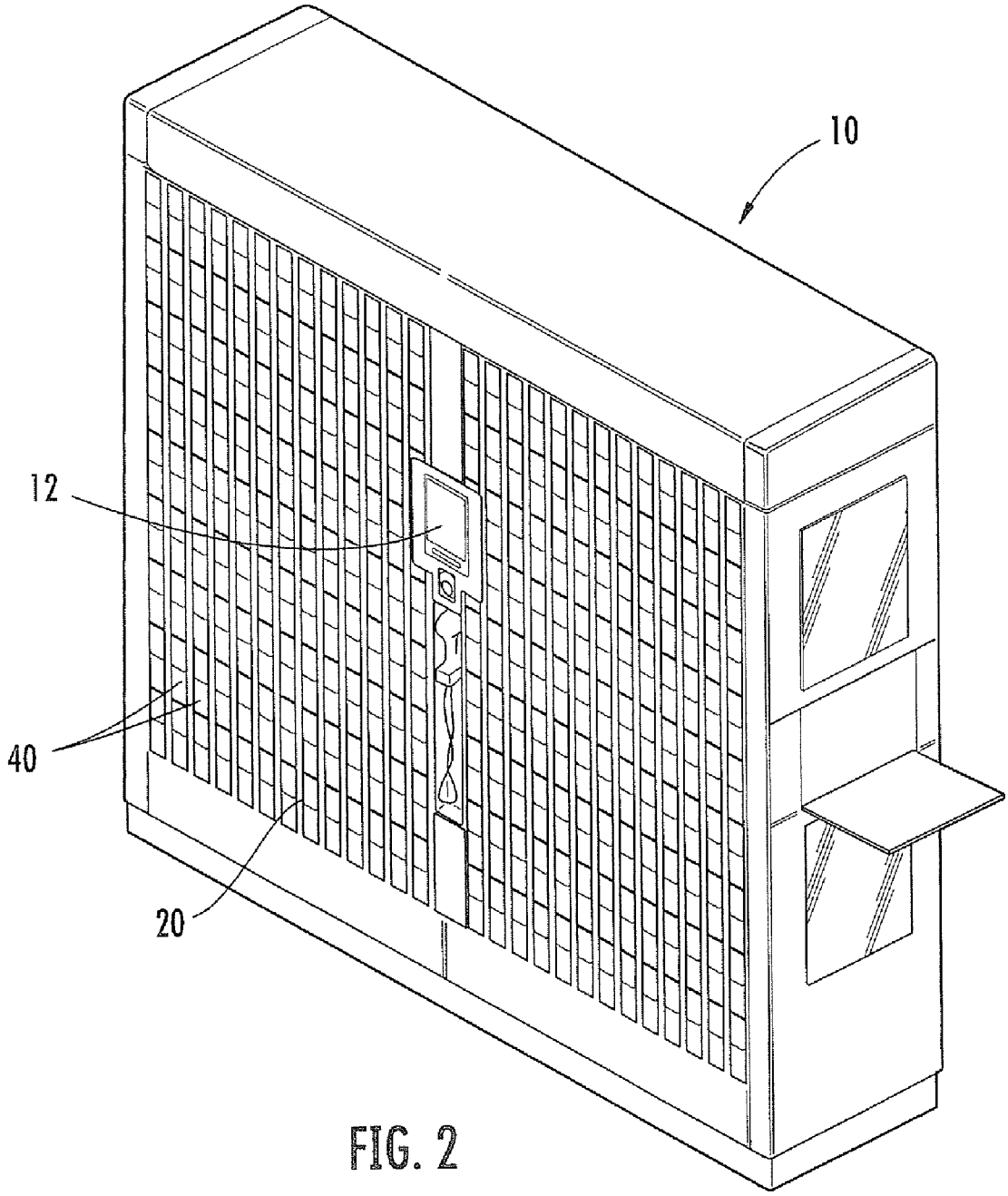
FIG. 2 is a top, front perspective view of a pharmaceutical dispensing system according to some embodiments of the present invention.
Figure 3:
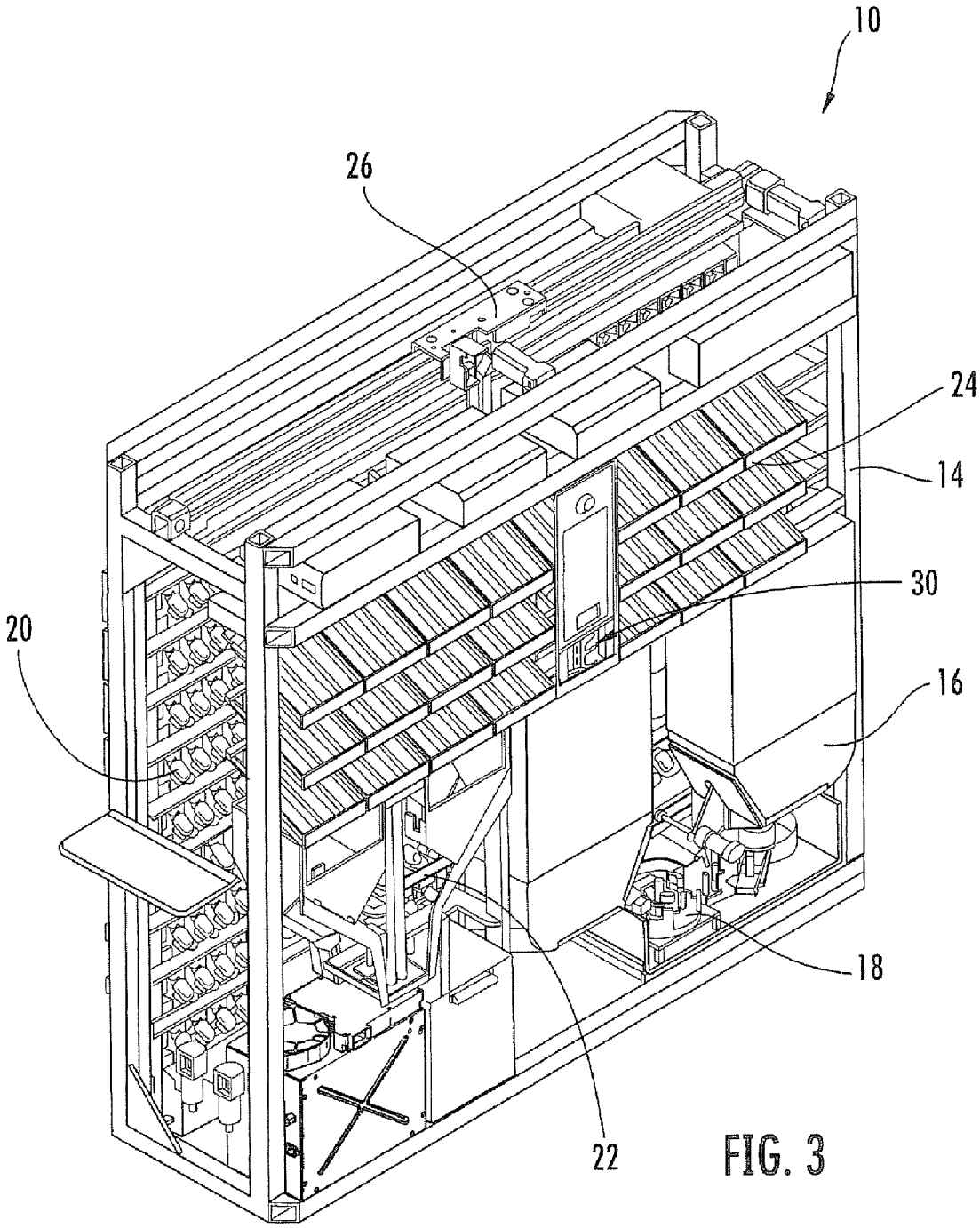
FIG. 3 is a top, rear perspective view of the system of FIG. 2 with the outer panel of the system removed to show the internal components.
Figure 4:
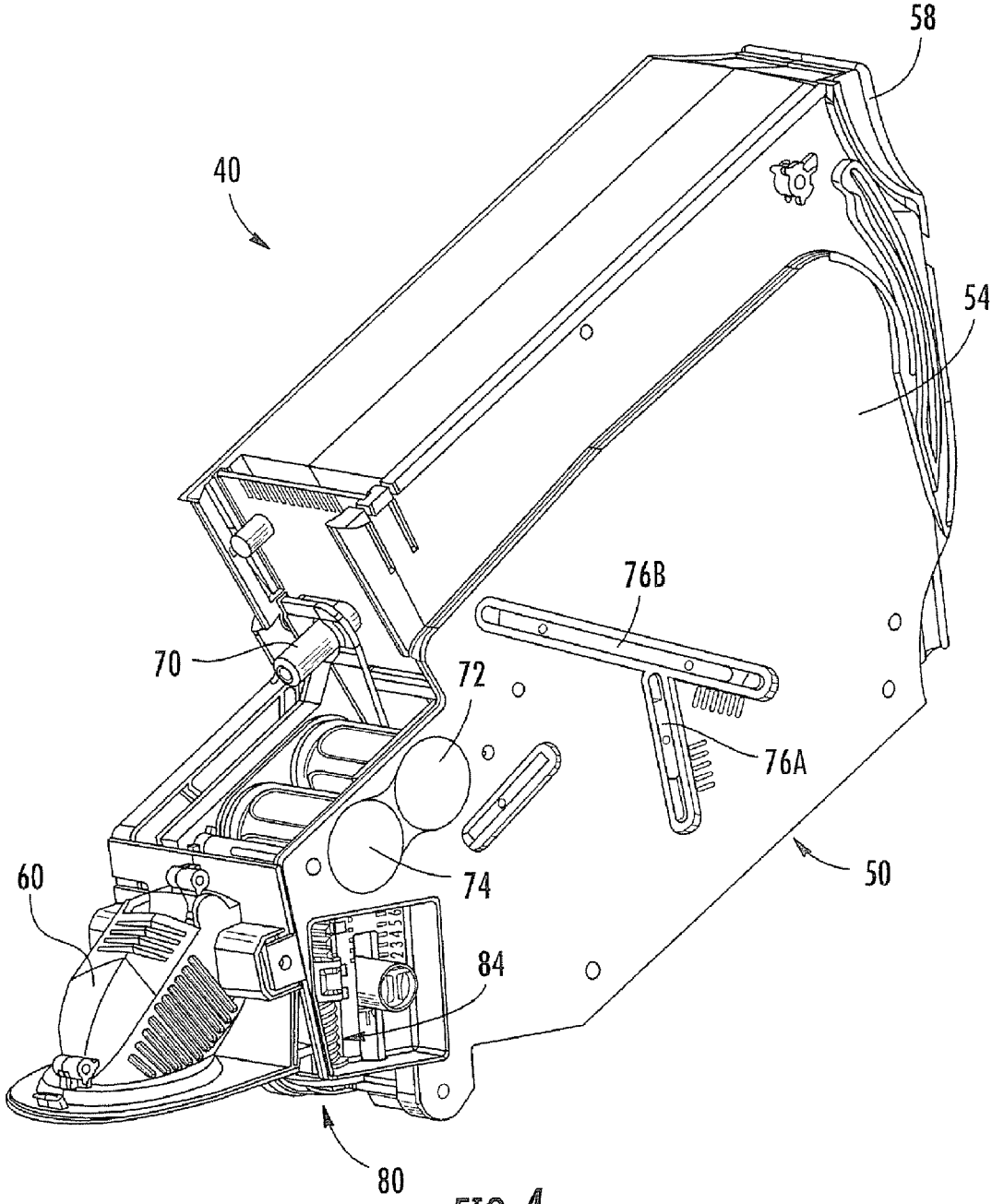
FIG. 4 is a front, right perspective view of a dispensing bin according to some embodiments of the present invention forming a part of the pharmaceutical dispensing system of FIG. 2.

A system that can carry out this process is illustrated in FIGS. 2-6C and designated broadly therein at 10 (FIGS. 2 and 3). The dispensing system 10 includes a support frame 14 for the mounting of its various components. Those skilled in this art will recognize that the frame 14 illustrated herein is exemplary and can take many configurations that would be suitable for use with the present invention. The frame 14 provides a strong, rigid foundation to which other components can be attached at desired locations, and other frame forms able to serve this purpose may also be acceptable for use with this invention.

The system 10 generally includes as operative stations a controller (represented herein by a graphical user interface 12), a container dispensing station 16, a labeling station 18, a tablet dispensing station 20, a closure station 22, and an offloading station 24. In the illustrated embodiment, containers, tablets and closures are moved between these stations with a dispensing carrier 26; however, in some embodiments, multiple carriers are employed. The dispensing carrier 26 has the capability of moving the container to designated locations within the frame 14. Except as discussed herein with regard to the dispensing station 20, each of the operative stations and the conveying devices may be of any suitable construction such as those described in detail in U.S. Pat. Nos. 6,971,541 and 7,344,049, and U.S. Patent Application Publication Nos. 2008/0110921, 2008/0110555, and 2008/0168751, the disclosures of which are hereby incorporated herein in their entireties.

The system 10 may also include a vial exception assembly 30 located on the same side of the system 10 as the offloading station 24 (see FIG. 3) as described in co-pending U.S. patent application Ser. No. 12/420,223, filed Apr. 8, 2009, the disclosure of which is hereby incorporated herein in its entirety.

The controller 12 controls the operation of the components of the system 10. In some embodiments, the controller 12 will be operatively connected with an external device, such as a personal or mainframe computer, that provides input information regarding prescriptions. In other embodiments, the controller 12 may be a stand-alone computer that directly receives manual input from a pharmacist or other operator. The controller 12 may be distributed with a portion thereof mounted on each bin as described hereinbelow. As used herein, the controller 12 may refer to a central controller and/or a dedicated controller onboard an associated bin. An exemplary controller is a conventional microprocessor-based personal computer.

In operation, the controller 12 signals the container dispensing station 16 that a container of a specified size is desired. In response, the container dispensing station 16 delivers a container to the labeling station 18. The labeling station 18 includes a printer that is controlled by the controller 12. The printer prints and presents an adhesive label that is affixed to the container. The carrier 26 moves the labeled container to the appropriate bin 40 for dispensing of tablets in the container.

Figure 6A:
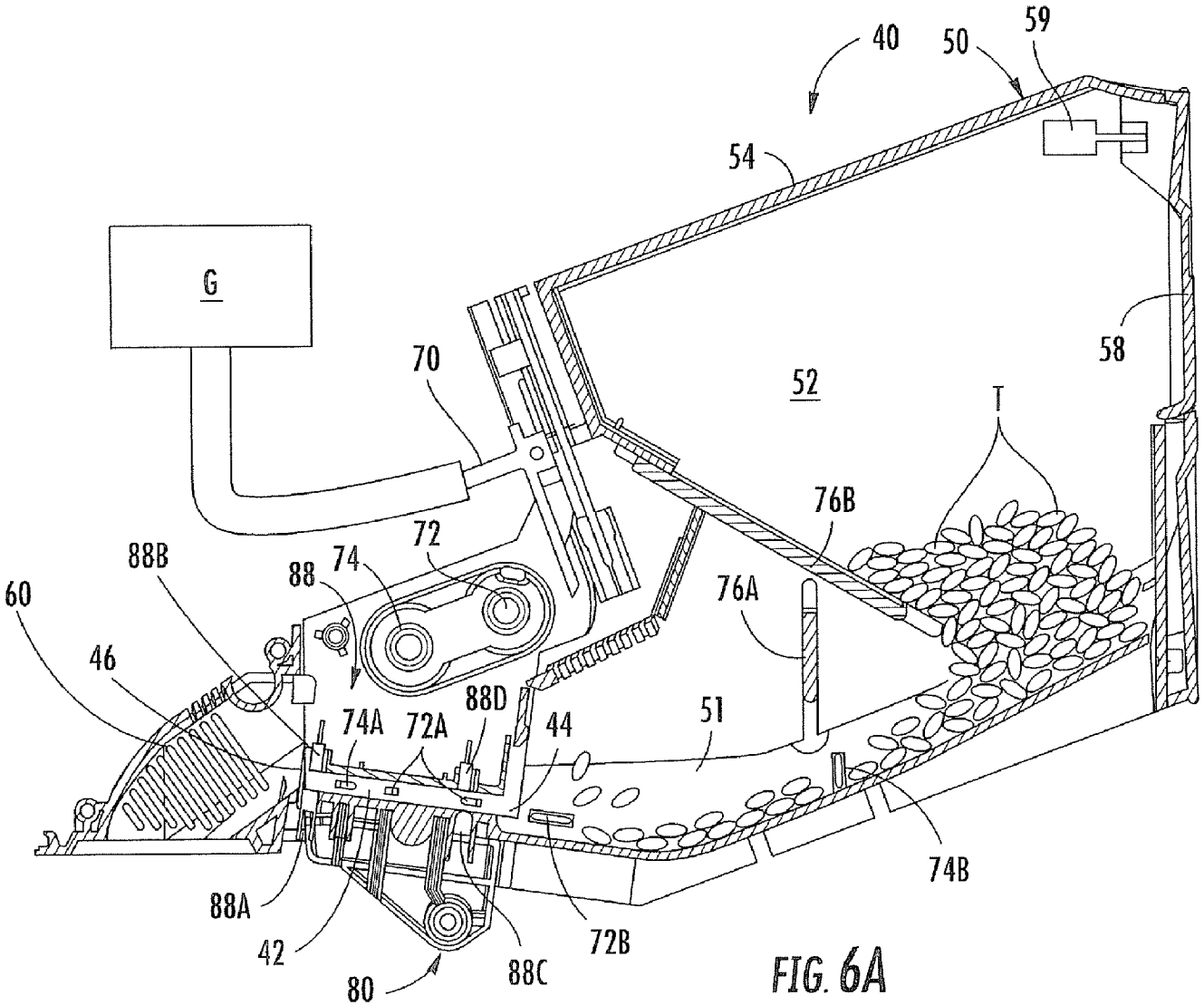
FIG. 6A is a cross-sectional view of the bin of FIG. 4.

Filling of labeled containers with tablets is carried out by the tablet dispensing station 20. The tablet dispensing station 20 comprises a plurality of tablet dispensing bin assemblies or bins 40 (described in more detail below), each of which holds a bulk supply of individual tablets (typically the bins 40 will hold different tablets). Referring to FIGS. 2, 3, and 6A, the dispensing bins 40, which may be substantially identical in size and configuration, are organized in an array mounted on the rails of the frame 14. Each dispensing bin 40 has a dispensing passage or channel 42 with an outlet 46 that faces generally in the same direction to create an access region for the dispensing carrier 26. In some embodiments, the identity of the tablets in each bin may be known by the controller 12, which can direct the dispensing carrier 26 to transport the container to the proper bin 40. In some embodiments, the bins 40 may be labeled with a bar code, RFID tag or other indicia to allow the dispensing carrier 26 to confirm that it has arrived at the proper bin 40.

The dispensing bins 40 are configured to singulate, count, and dispense the tablets contained therein, with the operation of the bins 40 and the counting of the tablets being controlled by the controller 12. Some embodiments may employ the controller 12 as the device which monitors the locations and contents of the bins 40; others may employ the controller 12 to monitor the locations of the bins, with the bins 40 including indicia (such as a bar code or electronic transmitter) to identify the contents to the controller 12. In still other embodiments, the bins 40 may generate and provide location and/or content information to the controller 12, with the result that the bins 40 may be moved to different positions on the frame 14 without the need for manual modification of the controller 12 (i.e., the bins 40 will update the controller 12 automatically).

Any of a number of dispensing units that singulate and count discrete objects may be employed if suitably modified to include the inventive aspects disclosed herein. In particular, dispensing units that rely upon targeted air flow and a singulating nozzle assembly may be used, such as the devices described in U.S. Pat. Nos. 6,631,826 and 7,344,049, and U.S. Patent Application Publication Nos. 2008/0283549 and 2008/0283543, each of which is hereby incorporated herein by reference in its entirety. Bins of this variety may also include additional features, such as those described below.

After the container is desirably filled by the tablet dispensing station 20, the dispensing carrier 26 moves the filled container to the closure dispensing station 22. The closure dispensing station 22 may house a bulk supply of closures and dispense and secure them onto a filled container. The dispensing carrier 26 then moves to the closed container, grasps it, and moves it to the offloading station 24.

Turning to the bins 40 in more detail, an exemplary bin 40 is shown in more detail in FIGS. 4-6C. The bin 40 includes a housing 50 having a hopper portion 54 and a nozzle 60. The bin 40 is fluidly connected with a pressurized gas source G (FIG. 6A).

Referring to FIG. 6A, the hopper portion 54 defines a hopper chamber 52 that can be filled with tablets T. The bin 40 can be filled or replenished with tablets through an opening located at the upper rear portion of the bin 40. The opening is selectively accessible via a pivoting door 58, for example, that normally resides in a closed position as shown in FIG. 6A and which can be pivoted open to access the opening. According to some embodiments, a locking assembly 59 is provided to selectively secure the door 58 in its closed position. The locking assembly may be constructed and operable in the manner described in U.S. Patent Application Publication No. 2008/0288105, the disclosure of which is incorporated herein by reference.

The tablets T can be dispensed one at a time into the container C (FIG. 6B) through the dispensing channel 42. The dispensing channel 42 has an inlet 44 adjacent and fluidly connecting the channel 42 to the hopper chamber 52. The dispensing channel 42 includes the outlet 46 downstream from and opposite the inlet 44 and through which tablets T may exit to be dispensed into the container C. The bin 40 defines a tablet dispensing path from the inlet 44, through the dispensing channel 42, through the outlet 46, and through the nozzle 60. According to some embodiments and as illustrated, the dispensing channel 42 is uniformly rectangular in cross-section from the inlet 44 to the outlet 46.

The hopper portion 54 has a bottom wall defining a floor 51. The floor 51 has a sloped rear portion that slopes downwardly toward the inlet 44. The floor 51 also has a funnel-shaped front portion. A front agitation port or outlet 72B and a rear agitation port or outlet 74B are provided in the floor 51. As discussed below, air or other pressurized gas can be flowed through the outlets 72B, 74B and into the hopper chamber 52 to agitate the tablets T contained therein.

One or more partition or divider walls 76A, 76B may extend through the hopper chamber 52 and form gaps or choke points and subchambers as described in U.S. Patent Application Publication No. 2008/0283549, the disclosure of which is incorporated herein by reference.

The housing 50 further includes a high-pressure supply port or nozzle 70. In use, the pressurized gas source G is fluidly connected to the high-pressure nozzle 70 via a manifold, fitting, flexible or rigid conduit, or the like. The gas source G may include a compressor or a container of compressed gas, for example. The high-pressure gas source G is operative to provide a supply gas flow of a suitable working gas at a high pressure to the nozzle 70. According to some embodiments, the supplied gas is or includes air. According to some embodiments, the pressure of the supplied gas at the nozzle 70 is at least about 10 psi and, according to some embodiments, between about 10 and 60 psi.

A gas supply passage or conduit fluidly connects the high-pressure nozzle 70 to a forward control valve 72. Two forward jet supply passages fluidly connect the forward control valve 72 to respective forward drive jet apertures or outlets 72A. The forward drive jet outlets 72A are positioned and configured to direct air or other supplied gas into the dispensing channel 42. A front agitation supply passage fluidly connects the forward control valve 72 to the front agitation outlet 72B to direct air or other supplied gas into the hopper chamber 52. The forward control valve 72 is operable to control airflow to the forward drive jet outlets 72A and the front agitation outlet 72B.

A further gas supply passage or conduit fluidly connects the high pressure nozzle 70 to a reverse control valve 74. A reverse jet supply passage fluidly connects the reverse control valve 74 to a reverse drive jet aperture or outlet 74A. The reverse drive jet outlet 74A is positioned and configured to direct air or other supplied gas into the dispensing channel 42. A rear agitation supply passage fluidly connects the reverse control valve 74 to the rear agitation outlet 74B to direct air or other supplied gas into the hopper chamber 52. The reverse control valve 74 is operable to control airflow to the reverse drive jet outlet 74A and the rear agitation outlet 74B.

The front and rear agitation outlets 72B, 74B may be provided with air amplifiers as described in U.S. Patent Application Publication No. 2008/0283549, the disclosure of which is incorporated herein by reference. The air amplifiers convert a supplied pressurized gas flow having a given pressure, velocity and mass flow rate into an exiting or output air flow having a comparatively lower pressure, and higher mass flow rate.

Alternative mechanisms may be used to provide the agitation gas flows discussed herein. For example, the system 10 may provide agitation flow using a separate low pressure manifold as disclosed in U.S. Pat. No. 7,344,049.

With reference to FIGS. 4-6A, the bin 40 further includes an adjustable dispensing channel subassembly 80. The subassembly 80 includes a fixed side wall 56, a ceiling member 81, a floor member 82, a follower side wall 83, a dispensing channel height adjustment mechanism 84, and a dispensing channel width adjustment mechanism 85.

The fixed side wall 56 is fixed with respect to and may be secured to or integrally formed with the housing 50. The drive jet outlets 72A, 74A are formed in the fixed side wall 56.

The floor member 82 includes a floor wall 82A. The floor member 82 is movable (e.g. slidable) left and right along an axis W-W relative to the fixed side wall 56. The floor wall 82A can be selectively moved relative to the fixed side wall 56 and set using the adjustment mechanism 85. The follower side wall 83 slides left and right with the floor wall 82A so that the lateral spacing between the follower side wall 83 and the fixed side wall 56 can be changed and set using the adjustment mechanism 85.

The ceiling member 81 includes a ceiling wall 81A and a side wall 81B. The ceiling member 81 is movable (e.g., slidable) up and down along an axis H-H relative to the fixed side wall 56 and the floor wall 82A. The heightwise spacing between the ceiling wall 81A and the floor wall 82A can be selectively changed and set using the adjustment mechanism 84. The follower side wall 83 slides up and down relative to the floor member 82 to accommodate repositioning of the ceiling member 81.

As illustrated, the adjustment mechanisms 84, 85 each comprise a thumbscrew adjuster 84A, 85A rotatably fixed in the housing 50 and operatively engaging threaded bores of the ceiling member 81 and the floor member 82, respectively. However, other types of adjustment mechanisms may be used.

Figure 5:
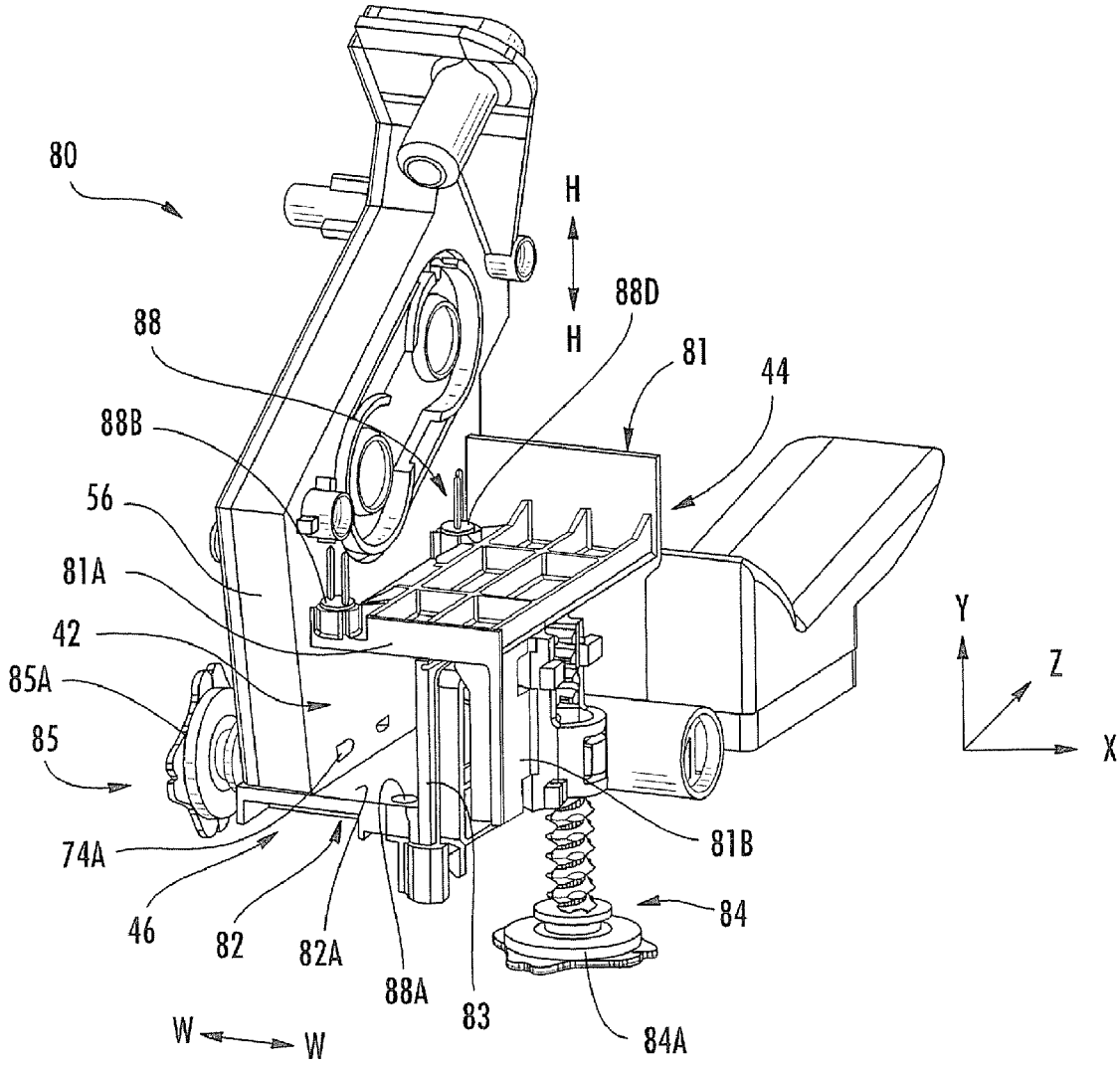
FIG. 5 is a front, right perspective view of an adjustable dispensing channel subassembly forming a part of the dispensing bin of FIG. 4.

The fixed side wall 56, the ceiling wall 81A, the floor wall 82A, and the follower side wall 83 together define the dispensing channel 42, the inlet 44, and the outlet 46. More particularly, the forward ends or edges of the components 56, 81, 82, 83 collectively form the outlet 46 (FIG. 5). The heightwise and widthwise dimensions of the dispensing channel 42, the inlet 44, and the outlet 46 can be selectively configured using the adjustment mechanisms 84, 85.

With reference to FIGS. 5 and 6A, the bin 40 includes a sensor system 88. The sensor system 88 includes an exit photoemitter 88A, an exit photosensor or photodetector 88B, an entrance photoemitter 88C (FIG. 6A), and an entrance photosensor or photodetector 88D. The sensor system 88 may further include a sensor system controller (e.g., the controller 12 or a dedicated controller on the bin 40) and/or an emitter driver (not shown) operative to monitor flow of tablets T through the dispensing channel 42. The photoemitter 88A and the photosensor 88B may cooperate as a first sensor pair and the photoemitter 88C and the photosensor 88D may cooperate as a second sensor pair. Additionally, the first and second sensor pairs may be cooperatively used or monitored as disclosed in U.S. Patent Application Publication Nos. 2008/0283543 and 2008/0283734, each of which is hereby incorporated herein by reference in its entirety.

The photodetectors 88B, 88D are mounted in the wall 81A. The photoemitters 88A, 88C are mounted in the wall 82A. The photodetector 88B and the photoemitter 88A are each positioned along and face the dispensing channel 42. According to some embodiments, the photodetector 88B and the photoemitter 88A are each positioned proximate (and, in some embodiments, at, in or immediately adjacent) the outlet 46 and the photodetector 88D and the photoemitter 88C are each positioned proximate (and, in some embodiments, at, in or immediately adjacent) the inlet 44.

According to some embodiments, the photoemitters 88A, 88C are photoelectric emitters and the photodetectors 88B, 88D are photoelectric sensors. According to some embodiments, the photoemitters 88A, 88C are infrared (IR) emitters and the photodetectors 88B, 88D are IR photosensors. According to some embodiments, the photoemitters 88A, 88C are ultra-violet (UV) emitters and the photodetectors 88B, 88D are UV photodetectors. According to some embodiments, the components 88A, 88B, 88C, 88D may each include both a photoemitter and a photodetector, whereby the components 88A, 88B, 88C, 88D may each serve as an emitter and a sensor, each configured to emit toward and receive from the other in its sensor pair. According to some embodiments, the components 88A, 88C may each be replaced with a retroreflective photoemitter/photodetector device and the components 88B, 88D may each be a cooperating reflector. Other combinations and configurations including a photoemitter and an associated photodetector may be employed. For the purpose of explanation, the illustrated embodiment will be described with only the components 88B, 88D being a photodetector (i.e., the photodetectors 88B, 88D receive photoemissions from the photoemitters 88A, 88C, respectively).

According to still further embodiments, the photoemitters 88A, 88C and the photodetectors 88B, 88D may be radiation emitters and radiation detectors of other suitable types that emit and detect corresponding radiation. Other suitable types of emitter/detector pairs may include ultrasonic emitters/detectors or electric field (e-field) emitters/detectors.

The photodetectors 88B, 88D are configured and positioned to detect the tablets T as they pass through the dispensing channel 42. The photodetectors 88B, 88D are configured to generate detection signals that are proportional to the light received thereby. The photoemitter 88A is positioned and configured to generate light that is directed toward the photodetector 88B across the dispensing pathway of the tablets T. Similarly, the photoemitter 88C is positioned and configured to generate light that is directed toward the photodetector 88D across the dispensing pathway of the tablets T. In this manner, when a tablet T interrupts the light transmitted from the photoemitter 88A, 88C to the photodetector 88B, 88D, the detection signal will change based on the reduced light being received at the respective photodetector 88B, 88D.

According to some embodiments, the sensor system controller uses detection signals from one or both of the photodetectors 88B, 88D to count the dispensed tablets, to assess a tablet or tablets, and/or to determine conditions or performance in tablet dispensing. In some cases, the controller 12 (or a dedicated controller on bin 40) operates the valves 72, 74 or other devices in response to signals received from sensor system 88 identifying or determining count, conditions or performance in dispensing. Suitable methods and operations are disclosed in U.S. Patent Application Publication No. 2008/0283543, the disclosure of which is incorporated herein by reference.

Exemplary operation of the dispensing system 10 will now be described. The bin 40 is filled with tablets T to be dispensed. The tablets T may initially be at rest. At this time, the valves 72, 74 are closed so that no gas flow is provided through the drive jet outlets 72A, 74A or the agitation outlets 72B, 74B.

If necessary, the adjustable dispensing channel subassembly 80 is suitably adjusted using the adjusters 84, 85 to provide the dispensing channel 42 and/or the inlet 44 with the appropriate dimensions for singulating the intended tablets T.

Figure 6B:
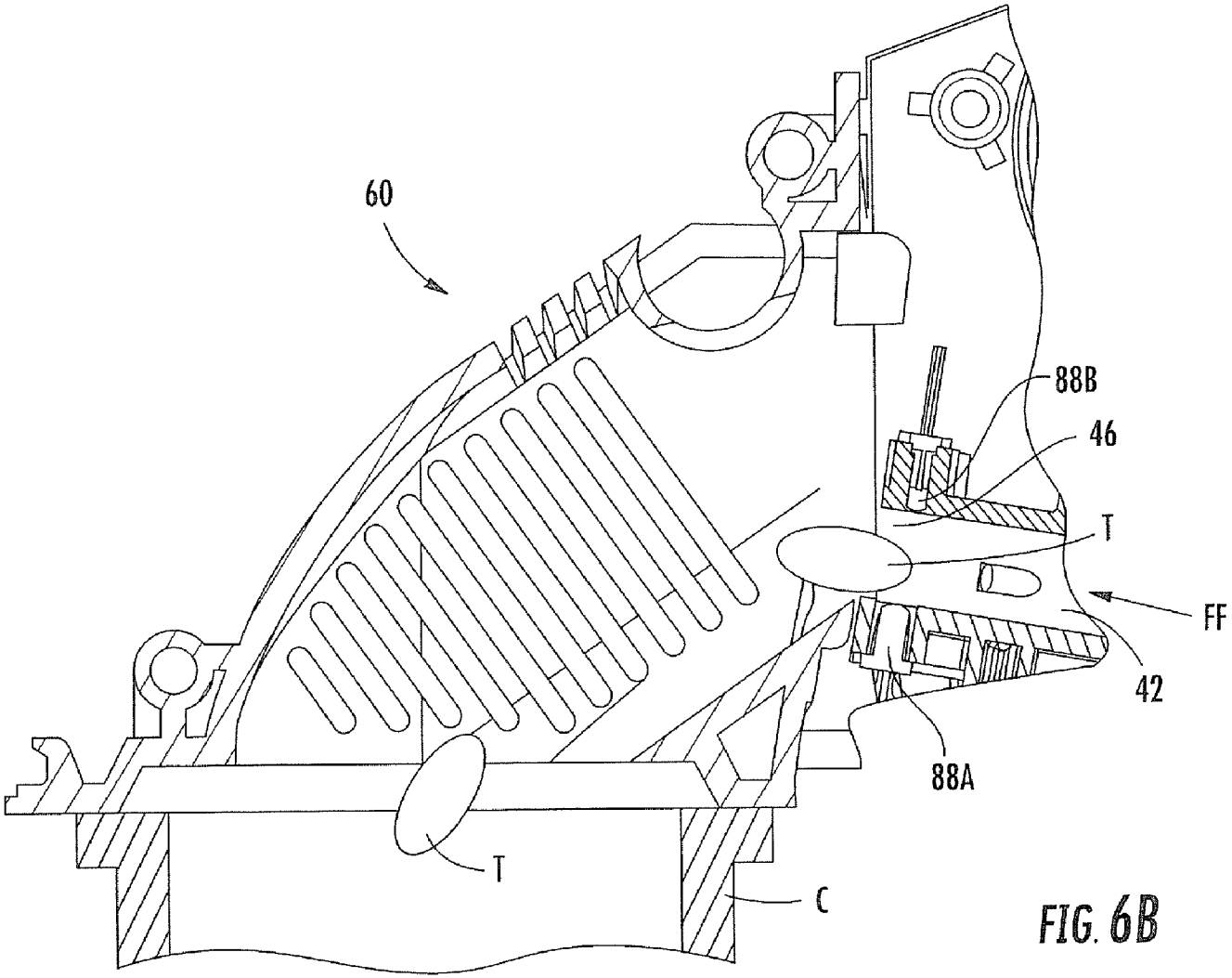
FIG. 6B is an enlarged, fragmentary cross-sectional view of the bin of FIG. 4 wherein tablets are being conveyed in a forward or dispensing direction.

When it is desired to dispense the tablets T to fill the container C, the dispensing carrier 26, directed by the controller 12, moves the container C to the exit port of the nozzle 60 of the selected dispensing bin 40. The controller 12 signals the forward valve 72 to open (while the reverse valve 74 remains closed). The opened valve 72 permits the pressurized gas from the gas source G to flow through the gas supply passages and out through the forward drive jet outlets 72A. The pressurized flow from the drive jet outlets 72A creates high velocity gas jets that generate suction that causes a forward flow FF of high pressure, high velocity air to be drawn outwardly through the dispensing channel 42 (FIG. 6B). Tablets T are oriented into a preferred orientation by the shape of the inlet 44 to the dispensing channel 42 and dispensed into the container C through the dispensing channel 42 and the outlet 46 under the force of the forward flow FF. The photodetectors 88B, 88D detect the tablets T as they pass through respective predetermined points in the dispensing channel 42.

The opening of the valve 72 also simultaneously permits the pressurized supply gas from the gas source G to flow through the front agitation outlet 72B to loft or otherwise displace (i. e., agitate) the tablets T in the hopper 52 proximate the inlet 44.

Figure 6C:
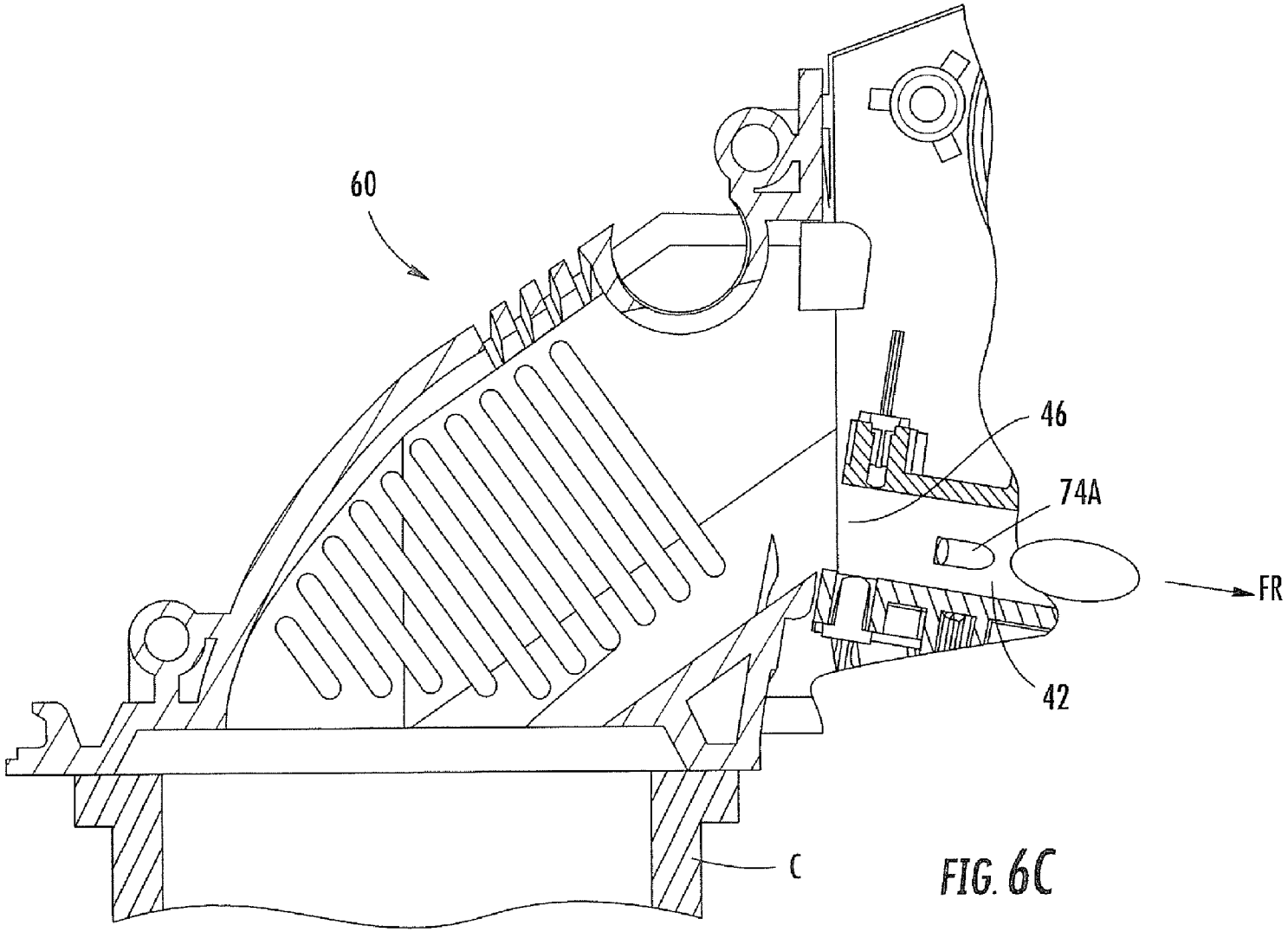
FIG. 6C is an enlarged, fragmentary cross-sectional view of the bin of FIG. 4 wherein tablets are being conveyed in a reverse direction.

Once dispensing is complete (i.e., a predetermined number of tablets has been dispensed and counted), the controller 12 activates the forward valve 72 to close and the reverse valve 74 to open. The opened valve 74 permits the pressurized gas from the gas source G to flow out through the reverse drive jet outlet 74A. The pressurized flow from the drive jet outlet 74A creates a high velocity gas jet that generates suction that causes a reverse (i.e., rearward) flow FR (FIG. 6C) of high pressure air to be drawn inwardly through the dispensing channel 42 toward the chamber 52. In this manner, the airflow is reversed and any tablets T remaining in the channel 42 are returned to the chamber 52 under the force of the reverse flow FR (FIG. 6C).

The opening of the valve 74 also simultaneously permits the pressurized supply gas from the gas source G to flow through the rear agitation outlet 74B to agitate the tablets T in the hopper 52.

During a dispensing cycle (i.e., when the forward flow FF is being generated), the controller 12 may determine that a tablet jam condition is or may be present. A tablet jam is a condition wherein one or more tablets are caught up in the bin 40 such that tablets T will not feed into or through the dispensing channel 42 under the pass of the forward flow FF. Tablets may form a jam at the nozzle inlet 44, one of the choke points or elsewhere so that no tablets are sensed passing through the dispensing passage 42 for a prescribed period of time while the forward air flow FF is being generated. Controller 12 will close the forward valve 72 and open the reverse valve 74 as described above for generating the reverse air flow FR and the rear agitation flow to clear a perceived tablet jam. These air flows may serve to dislodge any such jams as well as to loosen the tablets in the hopper 52.

While, in the foregoing description, the controller 12 controls the valves 72, 74, the valves 72, 74 may alternatively be controlled by a local controller unique to each bin 40.

A gate system or assembly may be provided adjacent the outlet 46 and/or the nozzle 60 as described in co-pending U.S. patent application Ser. No. 12/349,287, filed Jan. 6, 2009, the disclosure of which is incorporated herein by reference.

Typically, an operator will request that a desired number of tablets be dispensed ("the requested count"). The sensor system 88 detects the tablets T as they pass through predetermined points in the dispensing channel 42, as discussed in more detail below. The controller 12 uses the detection signals from the photodetector 88B and/or the photodetector 88D to monitor and maintain a registered count of the tablets T dispensed ("the system count"). When the system count matches the requested count, the controller 12 will deem the dispensing complete and cease dispensing of the tablets T.

Article fragments may be dispensed into the container C. For example, broken or fractured tablets may be introduced into the bin 40 during replenishment. Alternatively, tablets may break or fracture during the replenishing, agitation, and/or dispensing processes. As discussed above, it may be desirable to detect and/or classify an article fragment during the dispensing process.

Figure 7:
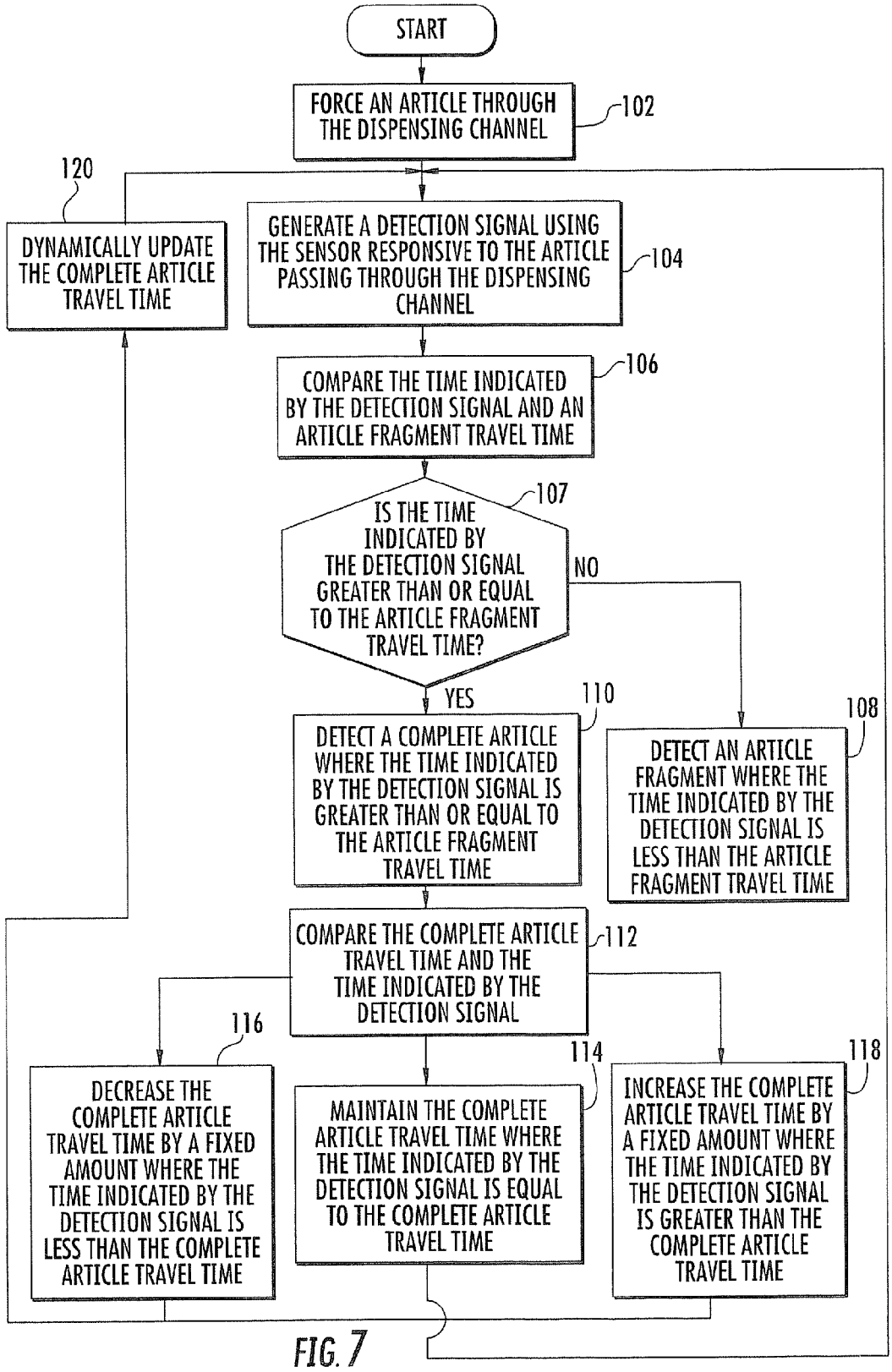
FIG. 7 is a flowchart illustrating operations according to some embodiments of the present invention.

FIG. 7 illustrates exemplary operations for detecting article fragments in accordance with some embodiments of the present invention. An article is forced through the dispensing channel 42 (Block 102). A detection signal is generated by a sensor, with the detection signal indicating a time that the article takes to traverse the sensor (Block 104). In some embodiments, the sensor is the photodetector 88B and the time indicated by the detection signal is the time that the article takes to traverse the photodetector 88B. In some other embodiments, the sensor is the photodetector 88D and the time indicated by the detection signal is the time that the article takes to traverse the photodetector 88D. In still other embodiments, the sensor includes the photodetector 88B and the photodetector 88D, and the time indicated by the detection signal is the time that the article takes to traverse both photodetectors 88B, 88D.

The time indicated by the detection signal is compared with an article fragment travel time (Block 106). The article fragment travel time represents an expected travel time for a complete article to traverse the sensor, with shorter times indicating passage of an article fragment, and is calculated and/or determined independent of physical attributes of the solid pharmaceutical articles, such as the solid pharmaceutical articles contained in a bin 40. Consequently, the article fragment travel time may represent a minimum travel time for a complete article to traverse the sensor and/or an upper time limit for an article fragment to traverse the sensor, and is calculated and/or determined independent of physical attributes of the solid pharmaceutical articles. The article fragment travel time may comprise a complete article travel time, representing an expected travel time that is calculated and/or determined independent of physical attributes of the solid pharmaceutical articles, such as the solid pharmaceutical articles contained in a bin 40, multiplied by a fragment fraction or percentage value. The fragment percentage value is configurable and represents a percentage of the article under which the article may be considered an article fragment, as described in more detail below. The complete article travel time may have an initial value that is configurable. In some embodiments, the initial value of the complete article travel time is configured to be about 0 milliseconds. In some other embodiments, the initial value of the complete article travel time is configured to approximate an expected time for the articles to traverse the sensor. In still other embodiments, the initial value of the complete article travel time assumes the travel time required for the first article forced through the dispensing channel 42 to traverse the sensor.

As noted above, the article fragment travel time and complete article travel time are calculated and/or otherwise determined independent of physical attributes (e.g., length, weight, volume) of the solid pharmaceutical articles. Furthermore, it is not necessary to provide a representative sample to determine or calibrate the article fragment travel time or the complete article travel time. Operations for determining and/or calculating the article fragment travel time and the complete article travel time are described in greater detail below with reference to Blocks 106-120 of FIG. 7.

The fragment percentage value provides an article fragment detection sensitivity. The fragment percentage value is configurable between the values of 0 and 1. The article fragment travel time and the complete article travel time are equal where the fragment percentage value is configured to be 1. The fragment percentage value may be based on how an operator wishes to define an article fragment. For example, a fragment percentage value of 0.75 (or ¾) may define an article as an article fragment if it has a certain characteristic (e.g., length, weight, volume) that is less than approximately 75% of the same characteristic of a typical article. As used herein, a "typical article" is defined as a solid pharmaceutical article that is substantially intact; in other words, a "typical article" is a solid pharmaceutical article that has not been broken or fractured. In some embodiments, the fragment percentage value is configured to be about 0.5.

Still referring to FIG. 7, based on the comparison (Block 106), it is determined whether the time indicated by the detection signal is greater than or equal to the article fragment travel time (Block 107). An article fragment is detected where the time indicated by the detection signal is less than the article fragment travel time (Block 108). According to some embodiments, the article fragment is excluded from the system count and/or an operator is alerted to the presence of the fragment. According to some embodiments, a container C containing a suspected article fragment is sent to an exception carousel within the exception assembly 30 as described in, for example, co-pending U.S. patent application Ser. No. 12/420,223, filed Apr. 8, 2009, the disclosure of which is hereby incorporated herein in its entirety.

A complete article is detected where the time indicated by the detection signal is greater than or equal to the article fragment travel time (Block 110).

In some embodiments, an article fragment is detected where the time indicated by the detection signal is less than or equal to the article fragment travel time and a complete article is detected where the time indicated by the detection signal is greater than the article fragment travel time.

FIG. 7 further illustrates exemplary operations for altering the complete article travel time and dynamically updating the complete article travel time in accordance with some embodiments of the present invention. The complete article travel time may be altered after a complete article is detected (Block 110). First, the time indicated by the detection signal is compared with the complete article travel time (Block 112). The complete article travel time is maintained where the time indicated by the detection signal is equal to the complete article travel time (Block 114). The complete article travel time is decreased by a fixed amount where the time indicated by the detection signal is less than the complete article travel time (Block 116). The complete article travel time is increased by a fixed amount where the time indicated by the detection signal is greater than the complete article travel time (Block 118). The complete article travel time may be decreased and increased by an equal fixed amount. The fixed amount(s) may be configurable. In some embodiments, the fixed amounts are equal and are configured to be about 0.1 milliseconds.

Alternatively, the complete article travel time may be altered by an amount that decreases as the complete article travel time increases. By way of example, the complete article travel time could be altered by 0.5 milliseconds until the complete article travel time reaches 10 milliseconds, at which point the complete article travel time could be altered by 0.2 milliseconds until the complete article travel time reaches 20 milliseconds, at which point the complete article travel time could thereafter be altered by 0.1 milliseconds.

The complete article travel time (and corresponding article fragment travel time) is dynamically updated (Block 120) in real-time. In this regard, the time indicated by the detection signal associated with the next article to traverse the sensor is compared with the updated complete article travel time and corresponding updated article fragment travel time.

The controller 12 or a dedicated controller associated with the bin 40 may be configured to perform the operations of FIG. 7.

The foregoing operations for detecting article fragments and dynamically updating the complete article travel time may offer several advantages. As noted above, article fragments may be discovered without being previously aware of the physical attributes or characteristics of the articles being dispensed. Furthermore, it is not necessary to provide a representative sample of the articles to set and/or calibrate the system. Instead, the system "learns" how to detect an article fragment by continually altering and updating the complete article travel time. The operations may be run as an algorithm, with the same algorithm, and possibly the same configurable values, applied to each bin 40 in the system 10. The algorithm associated with each bin 40 may thereby "teach" itself how to detect an article fragment, even where differently sized articles are contained within and dispensed from the various bins 40.

Moreover, the times indicated by the detection signals are not compared with an average travel time based on previous detection signals. An average travel time may be skewed by articles having artificially high travel times, such as momentarily stuck articles. As a result, complete articles could be incorrectly classified as fragments. Also, a sufficiently high sample population may be required before accurate fragment detection could begin.

In contrast, the methods according to some embodiments of the present invention described above allow for the detection of article fragments from the outset of the dispensing process. For example, the complete article travel time may be configured to have an initial value of 0 milliseconds. The complete article travel time is continually altered and updated as articles are dispensed ("the ramp-up time"). The system may detect relatively small fragments from the outset, with the system becoming increasingly sensitive to fragments as the complete article travel time begins to level out. The number of articles associated with the ramp-up time is typically small compared to the capacity of a bin 40. An article having an artificially high travel time may not have a significant effect on the complete article travel time and the duration of the ramp-up time (i.e., the complete article travel time will be increased only by a relatively small fixed amount).

The flowcharts of FIGS. 1 and 7 illustrate the architecture, functionality, and operations of embodiments of hardware and/or software according to various embodiments of the present invention. It will be understood that each block of the flowcharts, and combinations of blocks in the flowcharts, may be implemented by computer program instructions and/or hardware operations. In this regard, each block represents a module, segment, or portion of code, which comprises one or more executable instructions for implementing the specified logical function(s).

It should be noted that, in other implementations, the function(s) noted in the blocks may occur out of the order noted in FIGS. 1 and 7. For example, two blocks shown in succession may, in fact, be executed substantially concurrently, or the blocks may sometimes be executed in the reverse order, depending on the functionality involved.

The computer program instructions may be provided to a processor of a general purpose computer, a special purpose computer, or other programmable data processing apparatus to produce a machine, such that the instructions, which execute via the processor of the computer or other programmable data processing apparatus, create means for implementing the functions specified in the flowcharts.

The computer program instructions may also be stored in a computer usable or computer-readable memory that may direct a computer or other programmable data processing apparatus to function in a particular manner, such that the instructions stored in the computer usable or computer-readable memory produce an article of manufacture including instructions that implement the function specified in the flowcharts.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowcharts.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A method for dispensing and detecting solid pharmaceutical articles, the method comprising:

forcing an article through a dispensing channel and past a sensor configured and positioned to detect the article passing through the dispensing channel, wherein the article comprises one of the solid pharmaceutical articles;

generating a detection signal using the sensor responsive to the article passing through the dispensing channel, wherein the detection signal indicates a time that the article takes to traverse the sensor;

determining whether the article is a complete article or an article fragment responsive to a comparison of the time indicated by the detection signal and an article fragment travel time representing an expected travel time for a complete article to traverse the sensor that is determined independent of physical attributes of the solid pharmaceutical article, wherein the article fragment travel time comprises a complete article travel time, representing an expected travel time that is determined independent of physical attributes of the solid pharmaceutical articles, multiplied by a fragment percentage value, wherein the fragment percentage value is configurable and represents a percentage of the article under which the article is considered as an article fragment;

comparing the time indicated by the detection signal and the complete article travel time; and altering the complete article travel time responsive to the comparison of the time indicated by the detection signal and the complete article travel time.

2. The method of claim 1, wherein the fragment percentage value is about 0.5.

3. The method of claim 1, wherein determining whether the article is a complete article or an article fragment further comprises:

detecting a complete article where the time indicated by the detection signal is greater than or equal to the article fragment travel time; and detecting an article fragment where the time indicated by the detection signal is less than the article fragment travel time.

4. The method of claim 1, wherein altering the complete article travel time comprises altering the complete article travel time where the time indicated by the detection signal is greater than or equal to the article fragment travel time.

5. The method of claim 1, wherein altering the complete article travel time comprises:

increasing the complete article travel time by a first fixed amount where the time indicated by the detection signal is greater than the complete article travel time;

decreasing the complete article travel time by a second fixed amount where the time indicated by the detection signal is less than the complete article travel time;

maintaining the complete article travel time where the time indicated by the detection signal is equal to the complete article travel time.

6. The method of claim 5, wherein the first and second fixed amounts are about 0.1 milliseconds.

7. The method of claim 5, further comprising dynamically updating the article fragment travel time after altering the complete article travel time.

8. The method of claim 1, wherein the dispensing channel includes a dispensing channel inlet and a dispensing channel outlet downstream of the dispensing channel inlet, and wherein the sensor comprises a photodetector located proximate the dispensing channel outlet.

9. The method of claim 1, wherein the expected travel time for a complete article to traverse the sensor is determined independent of an average travel time based on previous detection signals.

10. An apparatus for dispensing and detecting solid pharmaceutical articles, the apparatus comprising:

a dispensing channel;

a drive mechanism to force an article through the dispensing channel, wherein the article comprises one of the solid pharmaceutical articles;

a sensor configured and positioned to detect the article passing through the dispensing channel and generate a detection signal responsive thereto; and a controller configured to:

receive the detection signal from the sensor responsive to the article passing through the dispensing channel, wherein the detection signal indicates a time that the article takes to traverse the sensor;

determine whether the article is a complete article or an article fragment responsive to a comparison of the time indicated by the detection signal and an article fragment travel time representing an expected travel time for a complete article to traverse the sensor that is determined independent of physical attributes of the solid pharmaceutical articles, wherein the article fragment travel time comprises a complete article travel time, representing an expected travel time that is determined independent of physical attributes of the solid pharmaceutical articles, multiplied by a fragment percentage value, wherein the fragment percentage value is configurable and represents a percentage of the article under which the article is considered as an article fragment;

compare the time indicated by the detection signal and the complete article travel time and alter the complete article travel time responsive to the comparison of the time indicated by the detection signal and the complete article travel time.

11. The apparatus of claim 10, wherein the fragment percentage value is about 0.5.

12. The apparatus of claim 10, wherein the controller is configured to:

identify a complete article where the time indicated by the detection signal is greater than or equal to the article fragment travel time; and identify an article fragment where the time indicated by the detection signal is less than the article fragment travel time.

13. The apparatus of claim 10, wherein the controller is configured to alter the complete article travel time where the time indicated by the detection signal is greater than or equal to the article fragment travel time.

14. The apparatus of claim 10, wherein the controller is configured to:

increase the complete article travel time by a first fixed amount where the time indicated by the detection signal is greater than the complete article travel time;

decrease the complete article travel time by a second fixed amount where the time indicated by the detection signal is less than the complete article travel time;

maintain the complete article travel time where the time indicated by the detection signal is equal to the complete article travel time.

15. The apparatus of claim 14, wherein the first and second fixed amounts are about 0.1 milliseconds.

16. The apparatus of claim 14, wherein the controller is configured to dynamically update the article fragment travel time after altering the complete article travel time.

17. The apparatus of claim 10, wherein the dispensing channel includes a dispensing channel inlet and a dispensing channel outlet downstream of the dispensing channel inlet, and wherein the sensor comprises a photodetector located proximate the dispensing channel outlet.

18. A computer program product for dispensing and detecting solid pharmaceutical articles, the computer program product comprising a non-transitory computer readable storage medium having computer readable program code embodied therein, the computer readable program code comprising:

computer readable program code that is configured to receive a detection signal from a sensor responsive to an article passing through a dispensing channel, wherein the article comprises one of the solid pharmaceutical articles, and wherein the detection signal indicates a time that the article takes to traverse the sensor;

computer readable program code that is configured to determine whether the article is a complete article or an article fragment responsive to a comparison of the time indicated by the detection signal and an article fragment travel time representing an expected travel time for a complete article to traverse the sensor that is determined independent of physical attributes of the solid pharmaceutical articles, wherein the article fragment travel time comprises a complete article travel time, representing an expected travel time that is determined independent of physical attributes of the solid pharmaceutical articles, multiplied by a fragment percentage value, wherein the fragment percentage value is configurable and represents a percentage of the article under which the article is considered as an article fragment;

computer readable program code that is configured to compare the time indicated by the detection signal and the complete article travel time; and computer readable program code that is configured to alter the complete article travel time responsive to the comparison of the time indicated by the detection signal and the complete article travel time.

* * * * *